US010276336B2

(12) United States Patent
Abbasi et al.

(10) Patent No.: US 10,276,336 B2
(45) Date of Patent: Apr. 30, 2019

(54) CIRCUIT BREAKER ASSEMBLY INCLUDING A CIRCUIT BREAKER CONNECTOR

(71) Applicant: ABB Schweiz AG, Baden, OT (CH)

(72) Inventors: Muneeb Ahmed Abbasi, Hyderabad (IN); Yatin Vilas Newase, Secunderabad (IN); Gajendra Vijaykumar Kadam, Hyderabad (IN); Simhadri Ramalingeswara Rao Gupta, Secunderabad (IN); Anurag Arjundas Jivanani, Plainville, CT (US)

(73) Assignee: ABB Schweiz AG, Baden (CH)

( * ) Notice: Subject to any disclaimer, the term of this patent is extended or adjusted under 35 U.S.C. 154(b) by 49 days.

(21) Appl. No.: 15/041,971

(22) Filed: Feb. 11, 2016

(65) Prior Publication Data

US 2016/0260568 A1 Sep. 8, 2016

(30) Foreign Application Priority Data

Mar. 6, 2015 (IN) ..... 1119/CHE/2015

(51) Int. Cl.
*H01H 71/02* (2006.01)
*H01H 69/00* (2006.01)
*H01H 9/34* (2006.01)

(52) U.S. Cl.
CPC ..... *H01H 71/025* (2013.01); *H01H 69/00* (2013.01); *H01H 71/0214* (2013.01);
(Continued)

(58) Field of Classification Search
CPC .. H01H 9/26; H01H 2300/046; H01H 9/0264; H01H 2071/0242; H01H 71/025;
(Continued)

(56) References Cited

U.S. PATENT DOCUMENTS 6,064,018 A * 5/2000 Seymour ..... H01H 71/0207 200/293
6,204,743 B1 * 3/2001 Greenberg ..... H01H 1/2058 218/22

(Continued)

FOREIGN PATENT DOCUMENTS

CN 101335157 A 12/2008
CN 201708101 U 1/2011

(Continued)

OTHER PUBLICATIONS

European Search Report and Opinion issued in connection with corresponding EP Application No. 6158521.1 dated Jul. 27, 2016.

(Continued)

*Primary Examiner* — Ahmed M Saeed
(74) *Attorney, Agent, or Firm* — Barnes & Thornburg LLP

(57) ABSTRACT

A circuit breaker assembly includes a circuit breaker cassette having a connector receiving zone, and a housing receptive of the circuit breaker cassette. The housing includes a connector mounting member. A circuit breaker connector member snap-fittingly extends into the connector receiving zone through the connector mounting member joining the circuit breaker cassette and the housing.

21 Claims, 6 Drawing Sheets

(52) U.S. Cl.
CPC ..... *H01H 71/0235* (2013.01); *H01H 9/342* (2013.01); *H01H 71/0271* (2013.01); *H01H 2071/0242* (2013.01)

(58) Field of Classification Search
CPC ..... H01H 69/00; H01H 71/0235; H01H 71/0214; H01H 71/0271; H01H 9/342
USPC ..... 200/293, 344, 401, 50.21, 530, 61.19; 335/8, 202, 172, 6
See application file for complete search history.

(56) References Cited

U.S. PATENT DOCUMENTS

| | | | | |
|---|---|---|---|---|
| 6,377,144 | B1 | 4/2002 | Castonguay et al. | |
| 6,750,743 | B1 * | 6/2004 | Subramanian | H01H 1/2058 200/306 |
| 6,930,573 | B2 | 8/2005 | Ciarcia et al. | |
| 6,933,814 | B2 | 8/2005 | Ciarcia et al. | |
| 7,633,365 | B2 | 12/2009 | Harmon et al. | |
| 2002/0122279 | A1 | 9/2002 | Greenberg et al. | |
| 2002/0153978 | A1 | 10/2002 | Greenberg et al. | |
| 2005/0057333 | A1 * | 3/2005 | Subramanian | H01H 1/2058 335/202 |
| 2015/0047953 | A1 * | 2/2015 | I-Te | H01H 3/16 200/47 |

FOREIGN PATENT DOCUMENTS

| | | | |
|---|---|---|---|
| DE | 69504258 | T2 | 2/1999 |
| DE | 102011087582 | A1 | 6/2013 |
| EP | 2009666 | A2 | 12/2008 |
| TW | M466909 | U | 12/2013 |
| WO | 0167473 | A2 | 9/2001 |

OTHER PUBLICATIONS

Office Action issued by Chinese Intellectual Property Agency in corresponding CN Appl. No. 201610122797.1, dated dated Aug. 2, 2018, 17 pages (including translation).

* cited by examiner 200
204
206
208
210
10
40
41
42
46
47
48
14
6
4
8
60
64
65
66

CIRCUIT BREAKER ASSEMBLY INCLUDING A CIRCUIT BREAKER CONNECTOR

BACKGROUND OF THE INVENTION

The subject matter disclosed herein relates to the art of circuit breakers and, more particularly, to a circuit breaker assembly including a circuit breaker connector for joining a circuit breaker cassette to a circuit breaker housing.

Electrical circuits often times include a circuit breaker to protect electrical conductors from undesirable circuit conditions. For example, circuit breakers may be employed to protect conductors from an over-current condition. Without a circuit breaker, conductors could be exposed to current levels that exceed design parameters. Circuit breakers typically include a switch mechanism that may be operated manually, or in the event of an undesirable circuit condition, automatically. Circuit breakers include single phase models, designed to protect a single conductor, and multi-phase models, designed to protect multiple conductors.

In a multi-phase model, an undesirable circuit condition experience in any one phase results in an activation that opens a circuit for each phase. More specifically, multi-phase circuit breakers may include a plurality of inter-connected cassettes that are mounted in a housing. Activation of a switch mechanism in any one of the plurality of inter-connected cassettes results in an activation of the switch mechanism in each cassette. Traditionally, the inter-connected cassettes are joined to the housing through electrically conductive mechanical fasteners. Of course, it should be understood that a single cassette may also be installed in the housing in a similar manner. In the event of a fault condition, an electrical conductive mechanical fastener could serve as an undesirable pathway to ground.

BRIEF DESCRIPTION OF THE INVENTION

According to an aspect of an exemplary embodiment, a circuit breaker assembly includes a circuit breaker cassette having a connector receiving zone, and a housing receptive of the circuit breaker cassette. The housing includes a connector mounting member. A circuit breaker connector member snap-fittingly extends into the connector receiving zone through the connector mounting member joining the circuit breaker cassette and the housing.

According to another aspect of an exemplary embodiment, a circuit breaker assembly includes a plurality of circuit breaker cassettes. Each of the plurality of circuit breaker cassettes includes a connector receiving zone. A housing is receptive of the plurality of circuit breaker cassettes. The housing includes a plurality of connector mounting members corresponding to each of the plurality of circuit breaker cassettes. One or more circuit breaker connector members snap-fittingly extend into one or more of the connector receiving zones through one or more of the connector mounting members joining the plurality of circuit breaker cassettes and the housing.

According to another aspect of an exemplary embodiment, a method of assembling a circuit breaker assembly includes installing at least one circuit breaker cassette into a cassette receiving portion of a housing, and snap-fittingly installing at least one circuit breaker connector member between the housing and the at least one circuit breaker cassette.

These and other advantages and features will become more apparent from the following description taken in conjunction with the drawings.

BRIEF DESCRIPTION OF DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
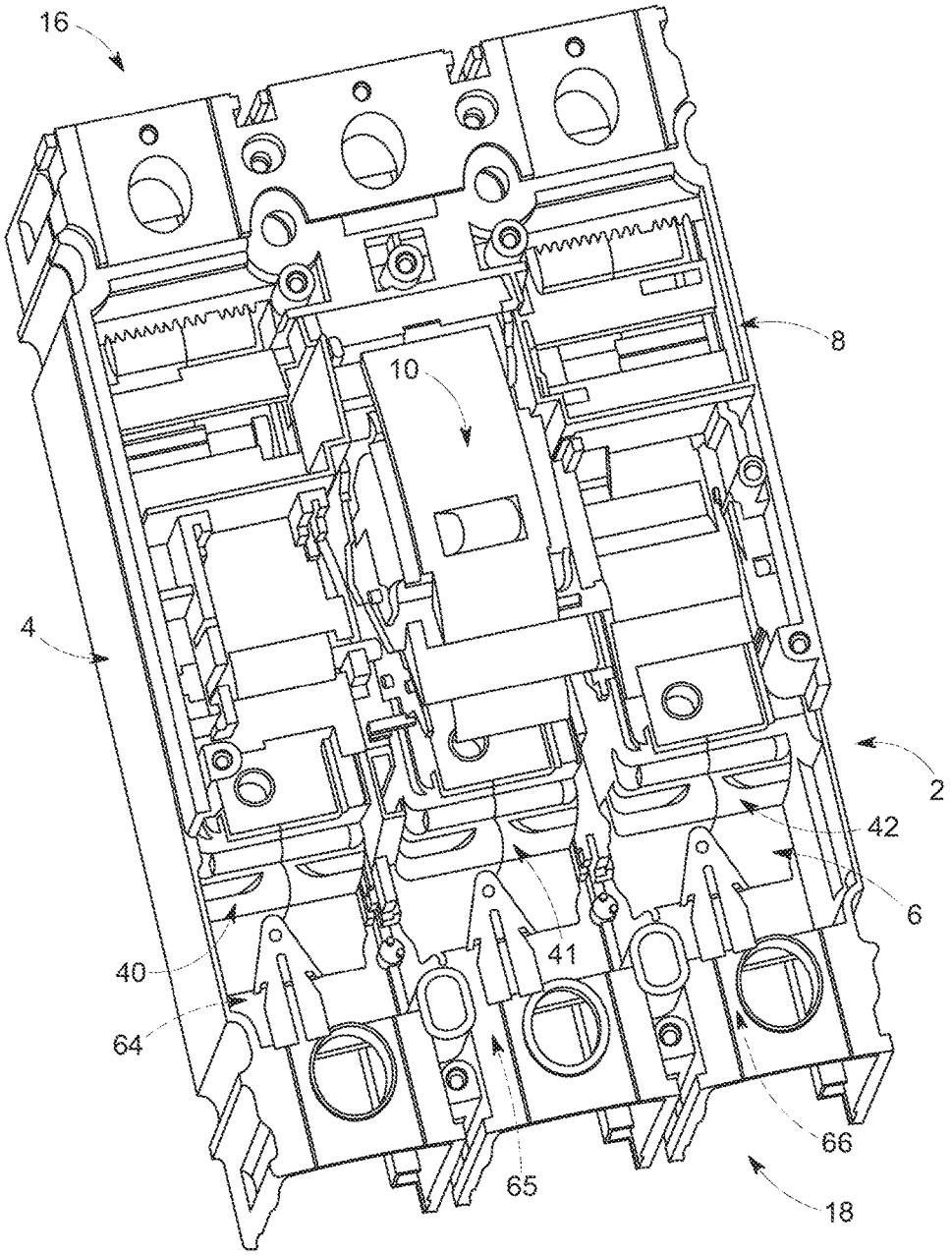
FIG. 1 depicts a multi-phase circuit breaker assembly including multiple circuit breaker cassettes joined to a circuit breaker housing through a non-conductive circuit breaker connector, in accordance with an exemplary embodiment.
Figure 2:
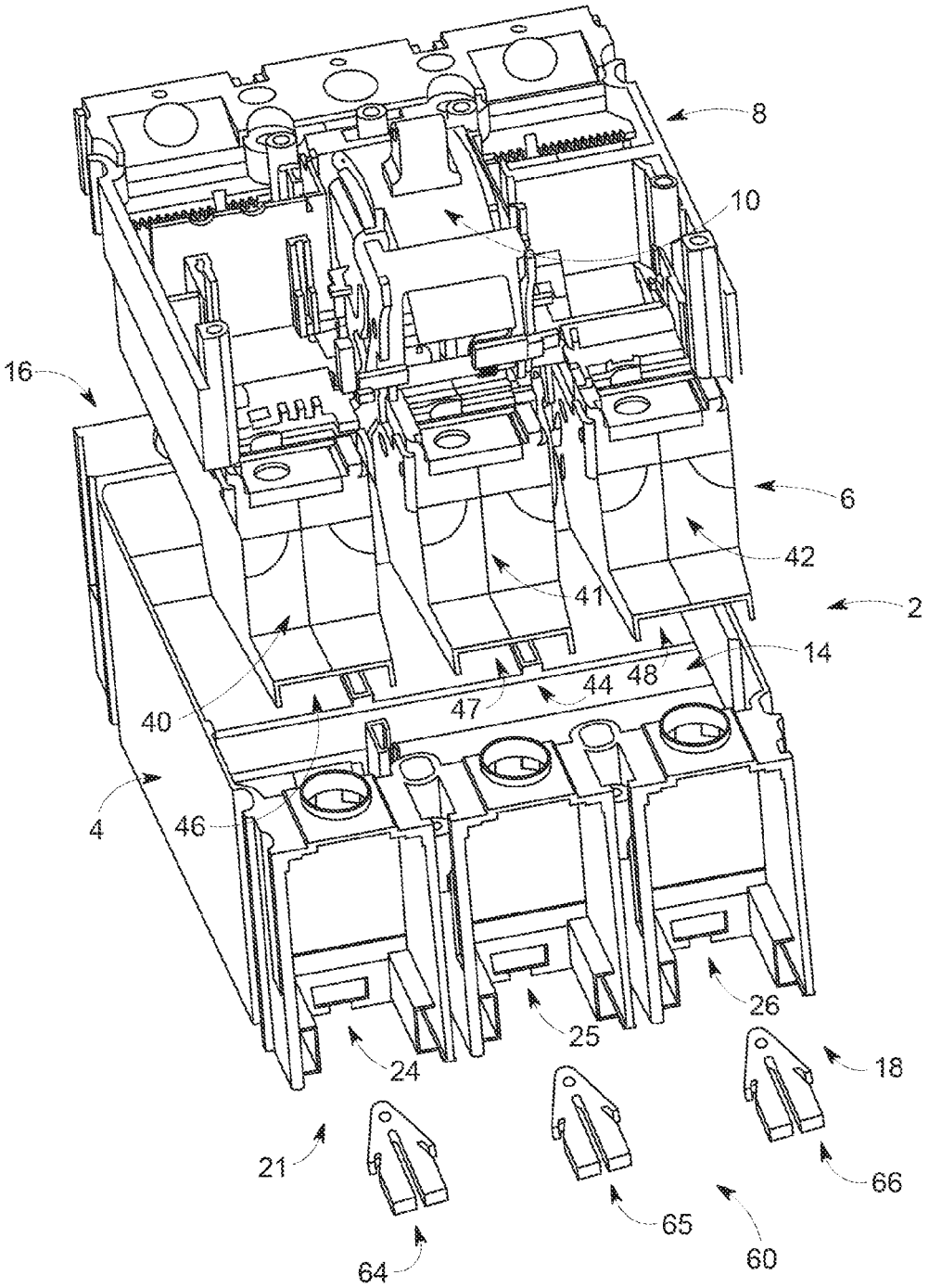
FIG. 2 depicts a partially exploded view of the multi-phase circuit breaker assembly of FIG. 1.

A circuit breaker assembly, in accordance with an exemplary embodiment, is indicated generally at 2, in FIGS. 1 and 2. Circuit breaker assembly 2 includes a housing 4 and a circuit breaker brick or cassette assembly 6. A cover or escutcheon 8 is arranged in circuit breaker cassette assembly 6. Escutcheon 8 includes a switch mechanism 10 that is selectively shiftable to open and close an electrical circuit. The switch mechanism 10 may be operated manually or in response to an undesirable circuit condition.

Housing 4 includes a circuit breaker cassette receiving portion 14 that houses circuit breaker pole cover, brick or cassette assembly 6, a first connector portion 16, and an opposing, second connector portion 18. First connector portion 16 houses a first plurality of connector lugs (not shown) and second connector portion 18 houses a second plurality of connector lugs (also not shown). The first and second pluralities of connector lugs provide an electrical interface to circuit breaker cassette assembly 6 for a source of electricity and an electrical load. Housing 4 also includes a plurality of connector mounting members 21. Connector mounting members 21 include a first connector mounting member 24, a second connector mounting member 25, and a third connector mounting member 26.

In the exemplary embodiment shown, circuit breaker cassette assembly 6 includes a first circuit breaker cassette 40, a second circuit breaker cassette 41, and a third circuit breaker cassette 42. Circuit breaker cassettes 40-42 may be operatively connected through inter-engaging linkages (not shown) and/or through switch member 10. Circuit breaker cassette assembly 6 also includes a plurality of connector receiving zones 44. More specifically, first circuit breaker cassette 40 includes a first connector receiving zone 46, second circuit breaker cassette 41 includes a second connector receiving zone 47, and third circuit breaker cassette 42 includes a third connector receiving zone 48.

When circuit breaker cassette assembly 6 is installed in housing 4, first, second, and third circuit breaker connector receiving zones 46-48 register with corresponding ones of first, second, and third connector mounting members 24-26. At this point, a plurality of circuit breaker connector members 60 are installed to join circuit breaker cassette assembly 6 and housing 4. In accordance with an aspect of an exemplary embodiment, circuit breaker conductor members 60 are non-conductive to electricity and may include a first non-conductive circuit breaker connector member 64 extends through first connector mounting member 24 into first connector receiving zone 46, a second non-conductive circuit breaker connector member 65 extends through second connector mounting member 25 into second connector receiving zone 47, and a third non-conductive circuit breaker connector member 66 extends through third connector mounting member 26 into third connector receiving zone 48. It should however be understood that circuit breaker connector members 60 may also be conductive to electricity if so desired.

Figure 3:
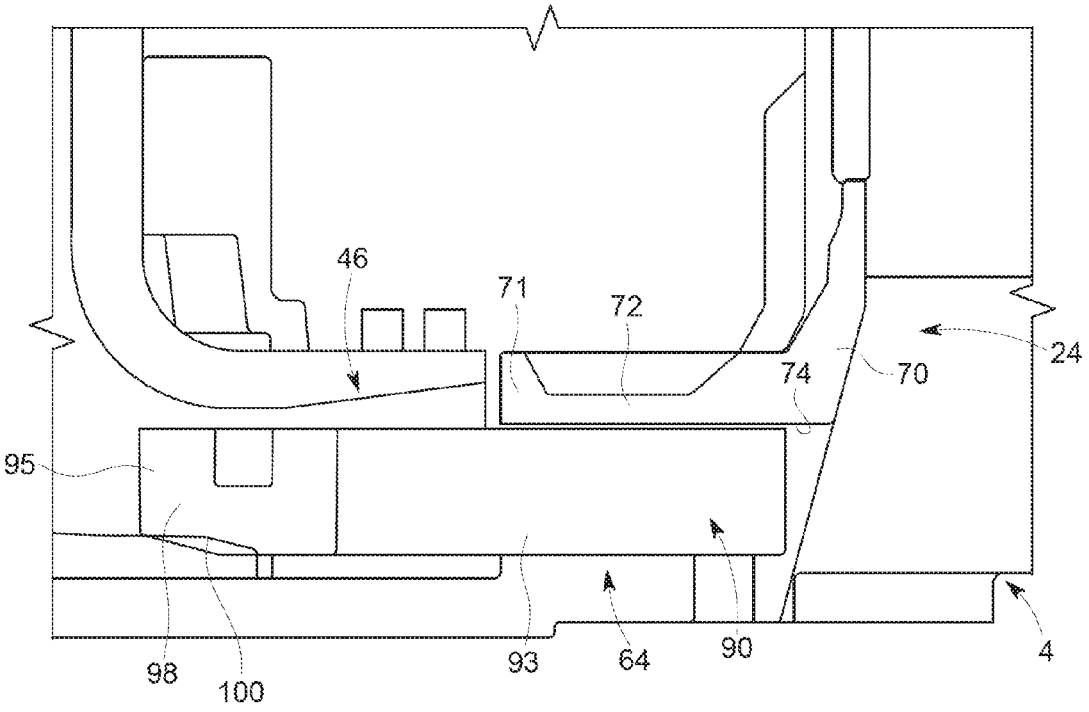
FIG. 3 depicts a non-conductive circuit breaker connector joining a circuit breaker cassette to the circuit breaker housing, in accordance with an exemplary embodiment.
Figure 4:
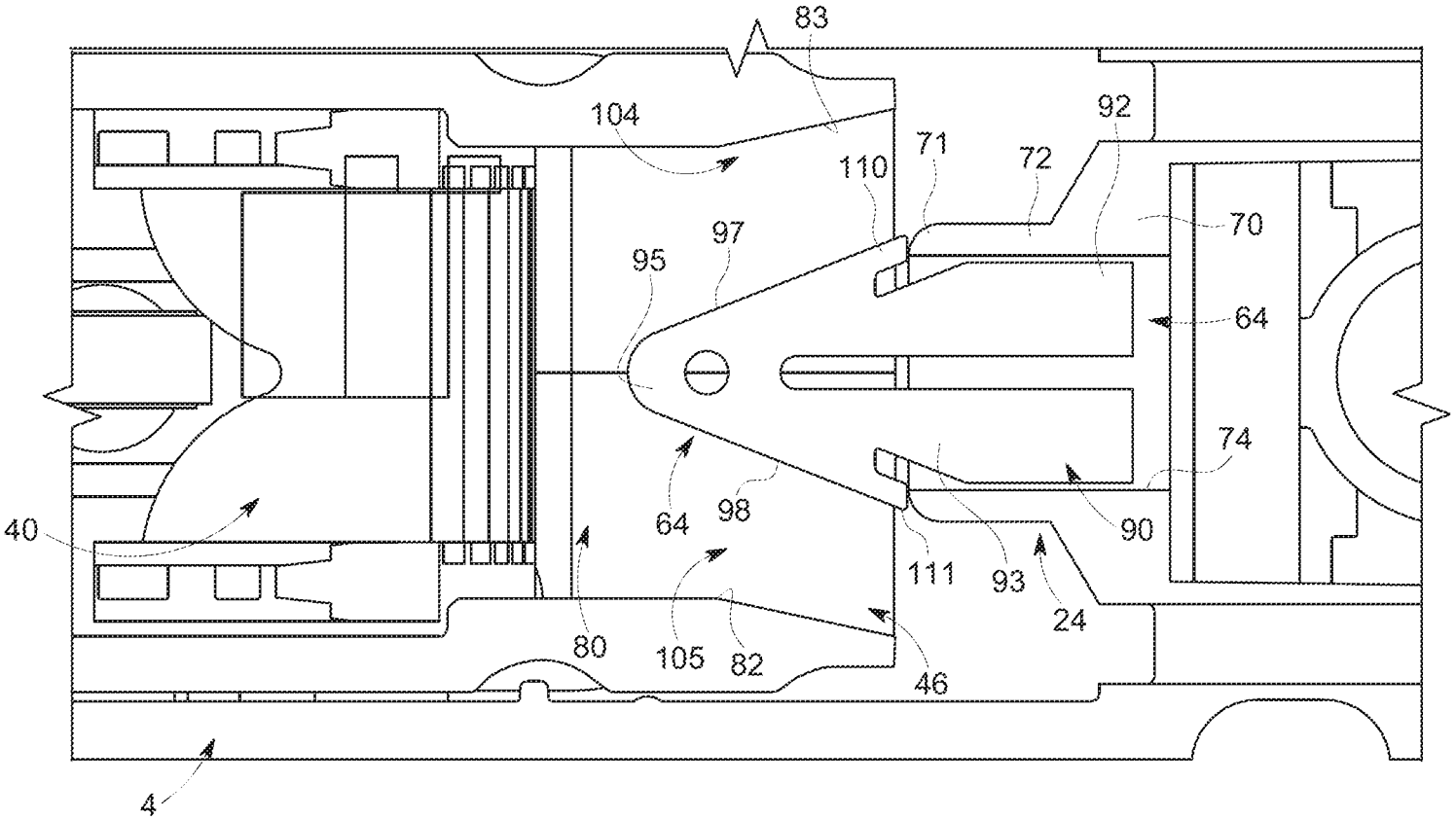
FIG. 4 depicts another view of the non-conductive circuit breaker connector of FIG. 3.

Reference will now follow to FIGS. 3 and 4 in describing first connector mounting member 24, first connector receiving zone 46, and first non-conductive circuit breaker connector member 64 with an understanding that the remaining circuit breaker mounting members 25 and 26, circuit breaker receiving zones 47 and 48, and non-conductive circuit breaker connector members 65 and 66 may include similar structure.

First connector mounting member 24 includes a first end 70, a second end 71 and an intermediate portion 72 extending therebetween. Intermediate portion 72 defines a connector passage 74 that substantially aligns with first connector receiving zone 46. In accordance with an aspect of an exemplary embodiment, first connector receiving zone 46 defines an exhaust duct 80 that provides a passage for gases to pass from first circuit breaker cassette 40. Gases may be generated during a fault condition. Exhaust duct 80 includes a first angled surface 82 and a second angled surface 83.

First non-conductive circuit breaker connector member 64 includes a body 90 formed from an electrically non-conducting, or electrically insulative, plastic. Of course, other non-electrically conducting materials may also be employed. Further, it should be understood that body 90 could be formed from an electrically conductive material that is encased in a non-electrically conductive coating. Body 90 includes a first portion 92 and a second portion 93. First portion 92 is linked to second portion 93 through a connecting portion (not separately labeled) defining an elastically deformable hinge 95. Elastically deformable hinge 95 includes a first angled surface portion 97 and a second angled surface portion 98 that form a generally v-shaped end portion (not separately labeled) of first non-conductive circuit breaker connector member 64. Elastically deformable hinge 95 also includes a chamfered surface portion 100. When installed in first connector receiving zone 46, first and second angled surface portions 97 and 98, together with first and second angled surfaces 82 and 83 form corresponding first and second angled exhaust channels 104 and 105. Further, chamfered surface portion 100 establishes a preload on first connector receiving zone 46 to provide a biasing force which retains first circuit breaker cassette 40 to housing 4.

First non-conductive circuit breaker connector member 64 also includes a first elastically deformable locking arm member 110 extending from first angled surface portion 97 and a second elastically deformable locking arm member 111 extending from second angled surface portion 98. First and second elastically deformable locking arm members 110 and 111 are biased inward toward first and second portions 92 and 93 when first non-conductive circuit breaker connector member 64 is passed through connector passage 74 and then extend outwardly upon passing into first connector receiving zone 46. In this manner, first non-conductive circuit breaker connector member 64 snap-fittingly engages with first connector mounting member 24 to secure first circuit breaker cassette 40 in housing 4.

Figures 5A, 5B, 5C, 5D, 5E:
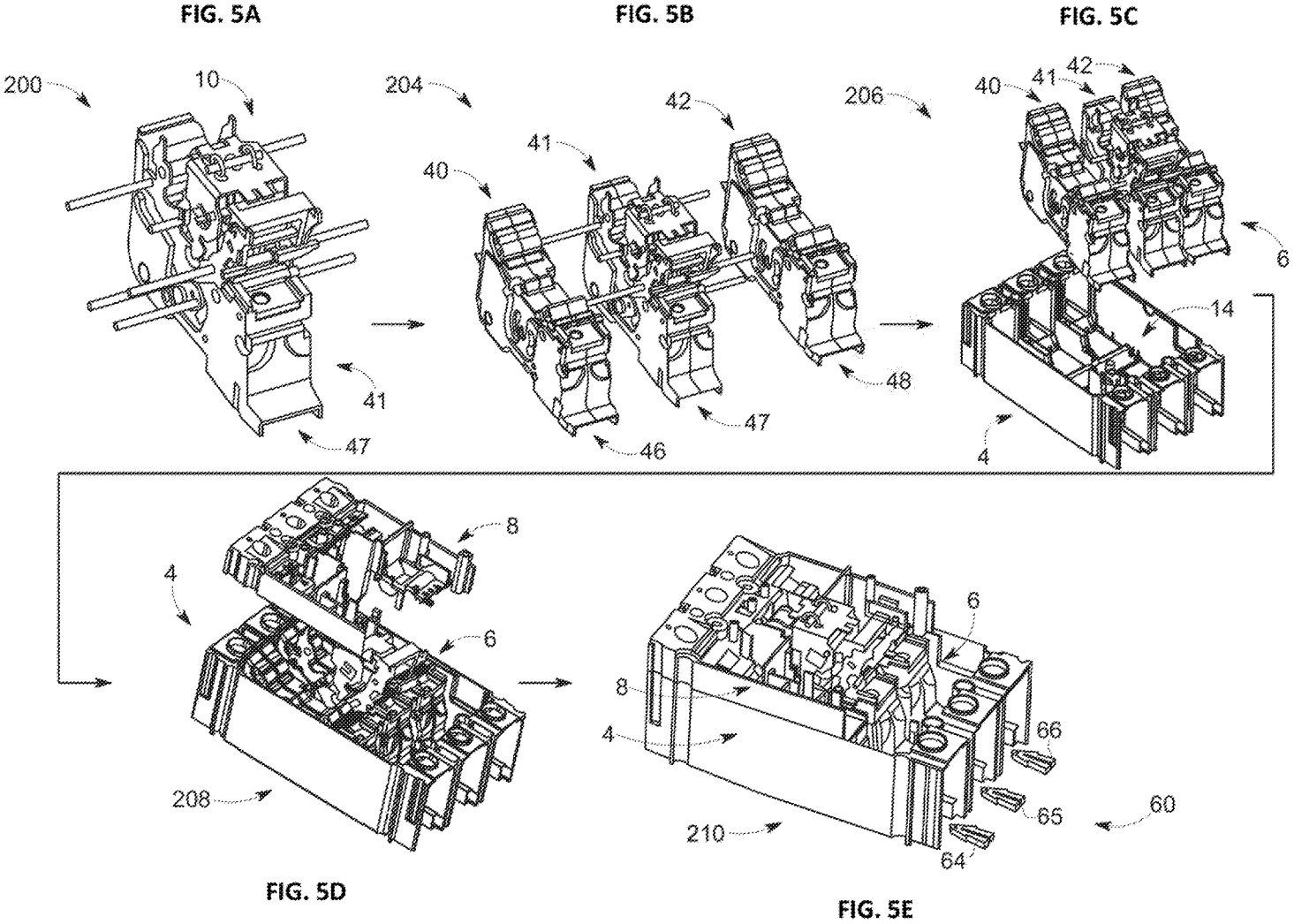
FIG. 5A-5E depicts steps for assembling the multi-phase circuit breaker assembly, in accordance with an exemplary embodiment.
Figure 6:
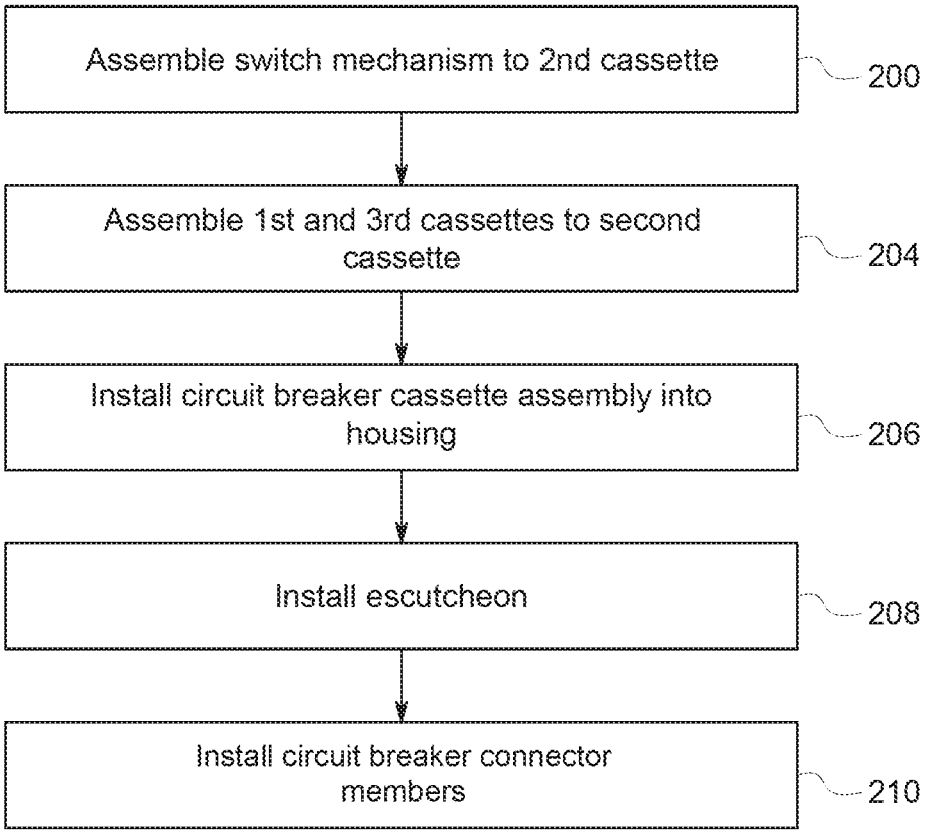
FIG. 6 depicts a flow chart illustrating a method of assembling the multi-phase circuit breaker assembly, in accordance with an exemplary embodiment.

FIGS. 5 and 6 depict steps for assembling circuit breaker assembly 2 in accordance with an aspect of an exemplary embodiment. Initially, switch mechanism 10 is installed to second circuit breaker cassette 41 as shown at 200. At this point, first circuit breaker cassette 40 and third circuit breaker cassette 42 may be assembled to second circuit breaker cassette 41 forming circuit breaker cassette assembly 6 as shown at 204. Circuit breaker cassette assembly 6 is installed into circuit breaker cassette receiving portion 14 of housing 4, as shown at 206, and escutcheon 10 is installed as shown at 208. At this point, non-conductive circuit breaker connector members 60 may be readily and easily installed into corresponding ones of connector receiving zones 46-48 through connector mounting members 24-26 to form multi-phase circuit breaker assembly 2 as shown at 210. As can be seen in FIG. 5, circuit breaker connector members 60 may be installed without the need for complex manipulation or tooling thereby simplifying an overall assembly process for circuit breaker assembly 2.

At this point it should be understood that the exemplary embodiments describe a non-conductive circuit breaker connector member that joins a circuit breaker cassette and a circuit breaker housing. By forming the connector from a material that does not conduct electricity, undesirable flow paths to ground may be eliminated. Further, in addition to eliminating undesirable flow paths to ground, the non-conductive circuit breaker connector member serves a dual purpose of guiding gases that may be generated during a fault condition from housing in a desired direction. It should also be understood that while shown as individual elements, the non-conductive circuit breaker connector members may be joined or ganged together as a single unit through, for example, one or more connecting webs. Further, it should be understood that, for example, a single non-electrically conductive circuit breaker connector member may be employed to join more than a single cassette to the housing.

In addition, the non-conductive circuit breaker connector members reduce manufacturing complexity and improve automation by eliminating the need for installing other types of mechanical fasteners. The snap-fit provided by the non-conductive circuit breaker connector members simplifies manufacturing techniques necessary to form a circuit breaker. More specifically, the non-electrically conductive circuit breaker connector members eliminate complex or not readily accessible fastener locations and the need for screws, which increase manufacturing costs and complexity. Further, while shown as being installed from a bottom portion of the circuit breaker assembly, the non-conductive circuit breaker connector members may be installed in other locations.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one more other features, integers, steps, operations, element components, and/or groups thereof.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A circuit breaker assembly comprising:

a circuit breaker cassette including a connector receiving zone defined therein;

a housing including a circuit breaker cassette receiving portion defined therein, the circuit breaker cassette receiving portion receptive of the circuit breaker cassette and defining a connector passage therethrough; and a circuit breaker connector member snap-fittingly extending into the connector receiving zone through the connector passage to secure the circuit breaker cassette to the circuit breaker cassette receiving portion of the housing, wherein the circuit breaker connector member includes at least one locking arm member engaging the housing.

2. The circuit breaker assembly according to claim 1, wherein the connector passage is substantially aligned with the connector receiving zone.

3. The circuit breaker assembly according to claim 1, wherein the at least one locking arm member comprises an elastically deformable arm member.

4. The circuit breaker assembly according to claim 1, wherein the circuit breaker connector member is non-conductive to electricity.

5. The circuit breaker assembly according to claim 1, wherein the circuit breaker connector member includes a first portion, a second portion, and a connecting portion, the connecting portion defining an elastically deformable hinge.

6. The circuit breaker assembly according to claim 1, wherein the connector receiving zone defines an exhaust duct configured to direct gases from the circuit breaker cassette.

7. The circuit breaker assembly according to claim 6, wherein the circuit breaker connector member includes an angled surface portion extending into the exhaust duct, the angled surface portion being configured and disposed to channel exhaust gases passing from the exhaust duct in a desired direction.

8. The circuit breaker assembly according to claim 1, wherein the circuit breaker connector member is formed from plastic.

9. A circuit breaker assembly comprising:

a plurality of circuit breaker cassettes, each of the plurality of circuit breaker cassettes including a respective connector receiving zone therein;

a housing including a circuit breaker cassette receiving portion defined therein, the circuit breaker cassette receiving portion receptive of the plurality of circuit breaker cassettes and defining a plurality of connector passages therethrough, each connector passage corresponding to a respective one of the plurality of circuit breaker cassettes; and one or more circuit breaker connector members snap-fittingly extending into one or more of the connector receiving zones through one or more connector passages to secure the plurality of circuit breaker cassettes to the circuit breaker cassette receiving portion of the housing, wherein each of the one or more circuit breaker connector members includes a first portion, a second portion, and a connecting portion, the connecting portion defining an elastically deformable hinge.

10. The circuit breaker assembly according to claim 9, wherein each connector passage is substantially aligned with the connector receiving zone.

11. The circuit breaker assembly according to claim 10, wherein each of the one or more circuit breaker connector members includes at least one locking arm member engaging the housing.

12. The circuit breaker assembly according to claim 11, wherein the at least one locking arm member comprises an elastically deformable arm member.

13. The circuit breaker assembly according to claim 9, wherein each of the one or more circuit breaker connector members is non-conductive to electricity.

14. The circuit breaker assembly according to claim 9, wherein each connector receiving zone defines an exhaust duct configured to direct gases from the corresponding circuit breaker cassette.

15. The circuit breaker assembly according to claim 14, wherein each of the one or more circuit breaker connector members includes an angled surface portion extending into the exhaust duct, the angled surface portion being configured and disposed to channel exhaust gases passing from the exhaust duct in a desired direction.

16. The circuit breaker assembly according to claim 9, wherein each of the one or more circuit breaker connector members is formed from plastic.

17. The circuit breaker assembly according to claim 9, wherein the plurality of circuit breaker cassettes including at least three circuit breaker cassettes mounted in the housing.

18. The circuit breaker assembly according to claim 9, wherein the plurality of circuit breaker cassettes are operatively connected.

19. A method of assembling a circuit breaker comprising:

installing at least one circuit breaker cassette having a connector receiving zone defined therein into a cassette receiving portion of a housing of the circuit breaker; and snap-fittingly inserting at least one circuit breaker connector member through at least one connector passage into the connector receiving zone to establish a preload on the connector receiving zone to provide a biasing force that secures the at least one circuit breaker cassette to the cassette receiving portion of the housing.

20. The method of claim 19, wherein installing the at least one circuit breaker cassette into the cassette receiving portion includes installing a plurality of circuit breaker cassettes into the cassette receiving portion.

21. The method of claim 20, wherein snap-fittingly inserting the at least one circuit breaker connector member includes snap-fittingly inserting the at least one circuit breaker connector member between the cassette receiving portion of the housing and one or more of the plurality of circuit breaker cassettes.

* * * * *